US006685990B1

(12) United States Patent
Zhong et al.

(10) Patent No.: US 6,685,990 B1
(45) Date of Patent: Feb. 3, 2004

(54) NODULE-FREE ELECTROLESS NIP PLATING

(75) Inventors: Linda Lijun Zhong, Fremont, CA (US); Connie Chunling Liu, San Jose, CA (US); Shawn A. Mawla, San Jose, CA (US); Jeff Duane St. John, Los Gatos, CA (US); Jeffrey Lee Petrehn, Fremont, CA (US)

(73) Assignee: Seagate Technology LLC, Scotts Valley, CA (US)

( * ) Notice: Subject to any disclaimer, the term of this patent is extended or adjusted under 35 U.S.C. 154(b) by 59 days.

(21) Appl. No.: 09/510,533

(22) Filed: Feb. 22, 2000

Related U.S. Application Data

(60) Provisional application No. 60/130,206, filed on Apr. 20, 1999.

(51) Int. Cl.[7] ..... B05D 1/18; B05D 5/12; B05D 1/36

(52) U.S. Cl. ..... 427/438; 427/129; 427/131; 427/132; 427/405; 427/443.1

(58) Field of Search ..... 427/129, 131, 427/132, 402, 405, 419.1, 438, 443.1

(56) References Cited

U.S. PATENT DOCUMENTS

| | | | | | |
|---|---|---|---|---|---|
| 3,348,969 | A | * | 10/1967 | Katz | 117/160 |
| 3,531,322 | A | | 9/1970 | Kefalas et al. | |
| 3,895,137 | A | * | 7/1975 | Avramidis et al. | 427/295 |
| 3,904,792 | A | | 9/1975 | Gulla et al. | |
| 3,961,109 | A | | 6/1976 | Kremer et al. | |
| 4,128,691 | A | | 12/1978 | Shirahata et al. | |
| 4,581,109 | A | | 4/1986 | Goor et al. | |
| 4,604,299 | A | | 8/1986 | De Luca et al. | |
| 4,619,872 | A | | 10/1986 | Goor et al. | |
| 4,659,605 | A | * | 4/1987 | Malik et al. | 427/129 |
| 4,929,499 | A | | 5/1990 | Shadzi et al. | |
| 4,933,010 | A | | 6/1990 | Okabayashi | |
| 5,153,044 | A | | 10/1992 | Chen et al. | |
| 5,284,520 | A | * | 2/1994 | Tanaka | 118/600 |
| 5,733,370 | A | * | 3/1998 | Chen et al. | 117/105 |
| 6,106,927 | A | * | 8/2000 | Zhong et al. | 428/141 |
| 6,153,802 | A | * | 11/2000 | Chiu | 570/123 |

* cited by examiner

*Primary Examiner*—Michael Barr
(74) *Attorney, Agent, or Firm*—McDermott, Will & Emery

(57) ABSTRACT

Abnormal nodule formation during electroless plating, e.g., of amorphous NiP "seed" layers utilized in the manufacture of magnetic recording media, is eliminated or substantially reduced by performing the electroless plating process in an apparatus employing polymeric or polymer-based materials which are substantially resistant to degradation upon prolonged contact with the electroless plating bath at an elevated temperature, i.e., release of soluble, low molecular weight, carbon-containing species which are incorporated in the electroless plating deposit and act as nucleation centers for abnormal growth leading to nodule formation. Suitable degradation-resistant polymeric materials for use as fittings, piping, racks, tanks, etc. of the electroless plating apparatus include fluorine-containing hydrocarbons and fluorocarbons.

18 Claims, 4 Drawing Sheets

1500X

1000X

1000X

1000X

1000X

1500X

NODULE-FREE ELECTROLESS NIP PLATING

CROSS-REFERENCE TO PROVISIONAL APPLICATION

This application claims priority from U.S. provisional patent application Ser. No. 60/130,206 filed Apr. 20, 1999, the entire disclosure of which is incorporated herein by reference.

FIELD OF THE INVENTION

The present invention relates to a method for depositing a nodule-free coating layer on a substrate surface by means of an electroless plating process. The invention has particular utility in depositing amorphous nickel-phosphorus (NiP) layers on suitably-shaped substrates, e.g., disk-shaped substrates, utilized in the manufacture of longitudinal magnetic recording media.

BACKGROUND OF THE INVENTION

Magnetic recording media are widely used in various applications, particularly in the computer industry. A conventional longitudinal magnetic recording disk medium 1 used in computer-related applications is schematically depicted in cross-sectional view in FIG. 1 and comprises a non-magnetic substrate 10 selected from metals, metal alloys, polymers, polymer-based materials, glass, ceramics, metal-ceramic composite materials, and glass-ceramic composite materials, typically an aluminum (Al)-based alloy, such as an aluminum-magnesium (Al—Mg) alloy, having sequentially deposited on at least one surface 10A thereof: a "seed" or plating layer 11, typically of an amorphous nickel-phosphorus material, such as NiP and $Ni_3P$; a polycrystalline underlayer 12, typically of chromium (Cr) or a Cr-based alloy; a magnetic recording layer 13, e.g., of a cobalt (Co)-based alloy; a protective overcoat layer 14, typically comprised of diamond-like carbon (DLC); and a lubricant topcoat layer 15, typically comprising a perfluoropolyether compound.

According to conventional automated manufacturing methodology for fabricating such type magnetic recording media, each of the polycrystalline underlayer 12, magnetic recording layer 13, and protective overcoat layer 14 is deposited on, e.g., an amorphous NiP- or $Ni_3P$-plated substrate, by a suitable physical vapor deposition (PVD) or chemical vapor deposition (CVD) technique, typically cathode sputtering. When utilized with relatively soft substrates, such as Al—Mg alloy substrates 10, the NiP plating layer 11 is typically deposited by an electroless plating process to form a layer having a thickness of about 15 $\mu$m, in order to increase the hardness of the substrate surface, thereby providing a suitable surface for subsequent polishing and/or texturing. The presence of amorphous NiP or $Ni_3P$ "seed" or plating layer 11 is also necessary for ensuring proper polycrystallinity of the Cr-based underlayer 12, which, in turn, is required for facilitating proper epitaxial growth thereover of a suitably polycrystalline magnetic recording layer 13. For example, an amorphous NiP or $Ni_3P$ "seed" layer 11 induces a Cr-based underlayer 12 deposited thereon to exhibit a (200) crystallographic orientation, which, in turn, causes the magnetic recording layer 13 deposited and epitaxially grown thereon to exhibit an advantageous bi-crystal cluster microstructure, as disclosed in U.S. Pat. No. 5,733,370, the entire disclosure of which is incorporated herein by reference.

In some instances, the "seed" layer 11 is provided with a textured or roughened surface to facilitate preferential alignment of the Cr-based underlayer 12 to exhibit the (200) crystallographic orientation or to reduce "stiction" between the transducer head and the recording medium when in use. In other instances, a requirement for substrates with high track-per-inch ("TPI") and low track mis-registration ("TMR") necessitates formation of NiP or $Ni_3P$ "seed" or plating layers 11 with defect-free surfaces after plating and/or polishing, with an attendant requirement for a high degree of planarity.

Suitable baths and procedures for electroless plating of non-magnetic nickel-phosphorus (NiP) amorphous "seed" or plating layers, wherein the formula "NiP" is taken to include all ratios of nickel-to-phosphorus, are disclosed in U.S. Pat. Nos. 3,531,322 and 4,659,605, the entire disclosures of which are incorporated herein by reference. By way of illustration only, a suitable electroless plating bath for deposition of amorphous NiP "seed" or plating layers consistent with the requirements of the present invention, includes a source of nickel ions (e.g., $NiCl_2$ or $NiSO_4$), a source of hypophosphite ions (e.g., $NaH_2PO_2$), a buffering agent, e.g., a carboxylic acid, boric acid or borate, and certain ester complexes, e.g., an ester complex of glucoheptonic acid, and stabilizing agents, etc. Another suitable NiP electroless plating bath includes a source of nickel ions, an unsaturated carboxylic acid, and a source of hypophosphite ions. In addition to these, electroless NiP plating baths usable within the context of the invention include, inter alia, Enthone 6450 (Enthone-OMI, New Haven, Conn.), Fidelity 4355 (OMG Fidelity Products Corp., Newark, N.J.), and U1C SHDX (Uyemura Int'l Corp., Ontario, Calif.).

NiP electroless plating baths, such as described above, can provide non- magnetic, amorphous NiP deposits, with a phosphorus (P) content within the range of from about 8 to about 12% and a corresponding nickel (Ni) content of from about 92 to 88%. Further, these baths are typically operated at an acidic pH, i.e., below about 5, and at an elevated temperature, i.e., above about 140° F., typically about 180–200° F., to provide a practically useful plating rate of about 3 to about $\mu$ inches/min. while still providing a non-magnetic deposit which does not become magnetic with age.

An essential requirement of the above-described NiP electroless plating process is that the thus-plated NiP layer be characterized by an unusually smooth surface which is free of imperfections such as nodules and pits. Prevention of formation of such imperfections is particularly important in the manufacture of rigid magnetic media, such as, for example, hard disks, since irregularities of any kind in excess of one-millionth of an inch can cause head crash or defective recording.

In practice, however, the requisite freedom from formation of surface irregularities during electroless plating of non-magnetic, amorphous NiP "seed" layers, such as the above-mentioned nodules and pits, frequently is not achieved in continuous manufacturing processing for the fabrication of magnetic recording media, e.g., hard disks, leading to increased substrate rejection rates. For example, abnormal nodule growth is frequently observed when less costly, more readily-available materials, e.g., polymeric or polymer-based materials, are utilized as components of the NiP electroless plating line in order to reduce or minimize equipment expense. Such abnormal nodule growth can result in the presence of residual "bumps" after post-deposition polishing of the NiP layer or add to the manufacturing cost by necessitating a two-step polishing process to ensure complete nodule removal. Moreover, in instances where a leveling agent is added to the NiP electroless plating bath to produce smooth layers, the effect of any abnormal nodule growth will be exacerbated.

Accordingly, there exists a need for an improved electroless plating process suitable for forming defect-free "seed"

or plating layers for use in the manufacture of high density magnetic recording media, which "seed" or plating layers are substantially free of abnormal nodule growth and require little or no post-deposition polishing prior to subsequent layer deposition thereon. In addition, there exists a need for an improved electroless processing methodology for manufacturing substrates for high-density magnetic recording media which is simple, cost-effective, and fully compatible with the productivity and throughput requirements of automated manufacturing technology.

The present invention fully addresses and solves the above-described problems attendant upon the formation of substrates utilized in the manufacture of high-density magnetic recording media, while maintaining full compatibility with all chemical and mechanical aspects of conventional recording media manufacturing technology.

DISCLOSURE OF THE INVENTION

An advantage of the present invention is an improved method of electroless plating of substrates.

Another advantage of the present invention is an improved method of nodule-free electroless plating of substrates utilized in the manufacture of high-density magnetic recording media.

Yet another advantage of the present invention is an improved method of nodule- and defect-free electroless plating of NiP "seed" or plating layers on disk-shaped substrates utilized in the manufacture of high-density magnetic recording media.

Still another advantage of the present invention is an improved method of manufacturing a magnetic recording medium.

A still further advantage of the present invention is an improved method of manufacturing a magnetic recording medium comprising a nodule-free NiP "seed" or plating layer.

Additional advantages and other features of the present invention will be set forth in the description which follows and in part will become apparent to those having ordinary skill in the art upon examination of the following or may be learned from practice of the present invention. The advantages of the present invention may be realized and obtained as particularly pointed out in the appended claims.

According to one aspect of the present invention, the foregoing and other advantages are obtained in part by a method of depositing a nodule-free coating layer on a substrate surface by an electroless plating process, wherein an electroless plating bath utilized for the plating is contained at an elevated temperature within a plating apparatus including at least one polymeric material, comprising performing said electroless plating process in a plating apparatus wherein the at least one polymeric material is substantially resistant to degradation by contact with the elevated temperature electroless plating bath.

According to an embodiment of the present invention, the temperature of the electroless plating bath is at least about 140° F., and the at least one polymeric material is substantially resistant to degradation which comprises release of soluble, low molecular weight, carbon-containing species into the elevated temperature electroless plating bath, which species promote nodule growth.

According to further embodiments of the present invention, the at least one polymeric material comprises at least one fluorine-containing polymer, e.g., at least one fluorine-containing hydrocarbon polymer such as polyvinylidene difluoride (PVDF) and poly(vinylidene fluoride-hexafluoropropylene).

According to still further embodiments of the present invention, the at least one polymeric material comprises at least one fluorocarbon polymer, e.g., polytetrafluoroethylene or a derivative or composite thereof According to yet further embodiments of the present invention, the electrolessly-plated coating layer comprises amorphous nickel-phosphorus (NiP); the substrate is a disk-shaped substrate for use in fabricating a magnetic recording medium and comprises a material selected from the group consisting of: metals, metal alloys (e.g., Al—Mg), polymers, glass, ceramics, metal-ceramic composite materials, and glass-ceramic composite materials.

According to another aspect of the present invention, a method of fabricating a magnetic recording medium comprises the sequential steps of:

(a) providing a disk-shaped substrate having a surface for deposition thereon; and (b) electrolessly depositing, from an electroless plating bath maintained at an elevated temperature at least about 140° F., a nodule-free, amorphous nickel-phosphorus (NiP) "seed" or plating layer on the substrate deposition surface, utilizing an electroless plating apparatus comprised of at least one polymeric material which does not release soluble, low molecular weight carbon-containing species into the elevated temperature electroless plating bath upon contact therewith.

According to an embodiment of the present invention, the method further comprises the sequential steps of:

(c) forming a polycrystalline underlayer over the NiP "seed" or plating layer;

(d) forming a magnetic recording layer over the underlayer;

(e) forming a protective overcoat layer over the magnetic recording layer; and (f) forming a lubricant topcoat layer over the protective overcoat layer.

According to further embodiments of the present invention, step (b) comprises utilizing an electroless plating apparatus comprising at least one fluorine-containing polymer, e.g., at least one fluorine-containing hydrocarbon polymer such as polyvinylidene difluoride (PVDF) and poly(vinylidene-hexafluoropropylene), or at least one fluorocarbon polymer such as polytetrafluoroethylene or a derivative or composite thereof According to yet another aspect of the present invention, a method of electrolessly depositing a nodule-free layer of a plating material on a substrate surface comprises:

(a) providing a substrate having a surface; and (b) utilizing a means for nodule-free electroless plating of the layer of plating material on the substrate surface.

According to an embodiment of the present invention, the layer of plating material is amorphous NiP.

Additional advantages of the present invention will become readily apparent to those skilled in the art from the following detailed description, wherein embodiments of the invention are shown and described, simply by way of illustration of the best mode contemplated for practicing the present invention. As will be described, the present invention is capable of other and different embodiments, and its several details are susceptible of modification in various obvious respects, all without departing from the spirit of the present invention. Accordingly, the drawings and description are to be regarded as illustrative in nature, and not as limitative.

BRIEF DESCRIPTION OF THE DRAWINGS

The following detailed description of the present invention can best be understood when read in conjunction with the following drawings, wherein:

FIGS. 2–6 are photomicrographs of the surfaces of electrolessly-deposited amorphous NiP "seed" or plating layers formed under various conditions.

DESCRIPTION OF THE INVENTION

Figure 1:
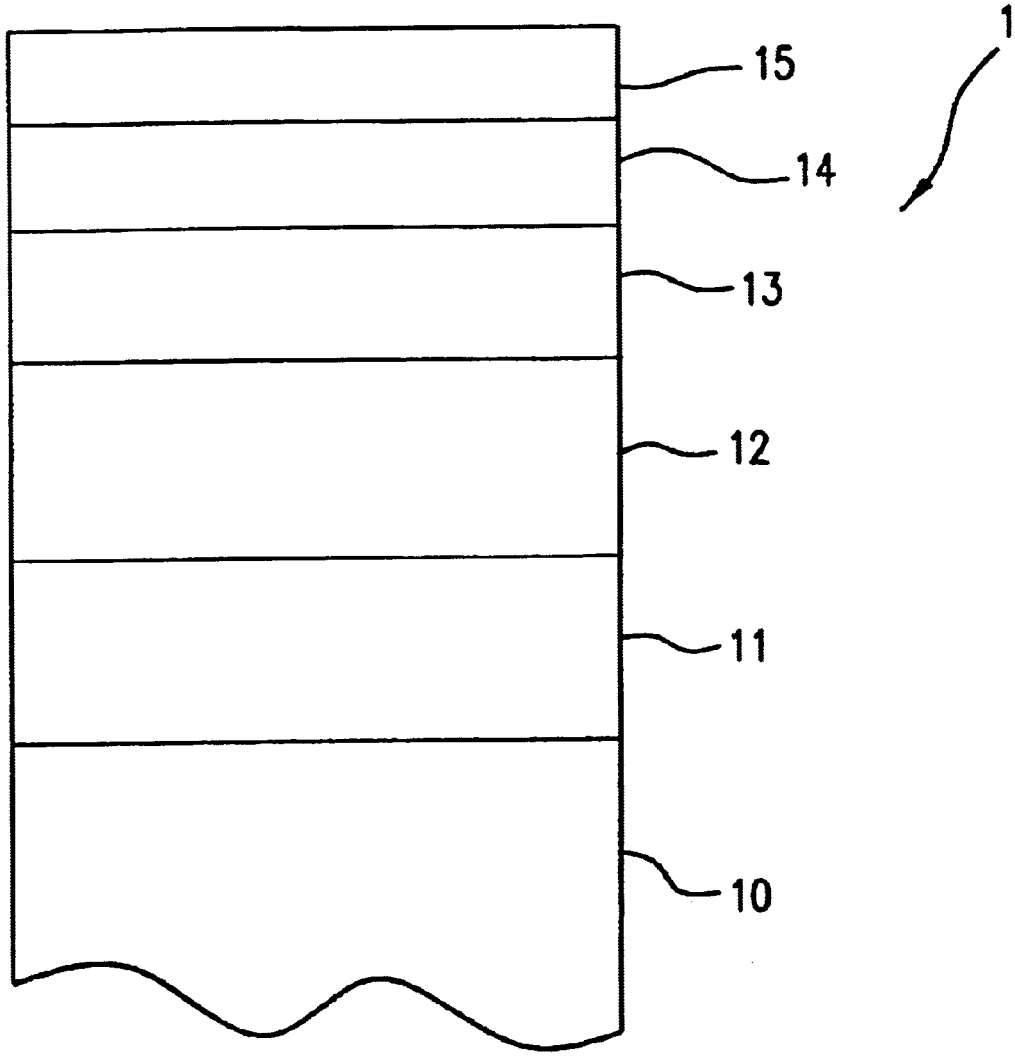
FIG. 1 PRIOR ART
FIG. 1 schematically illustrates, in cross-sectional view, a conventional magnetic recording medium comprising a NiP "seed" or plating layer.
Figure 1A:
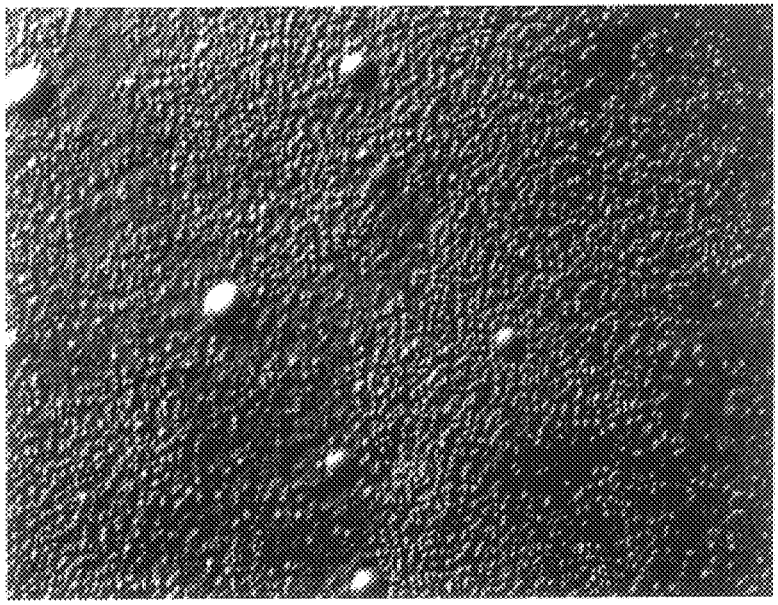
Figure 1B:
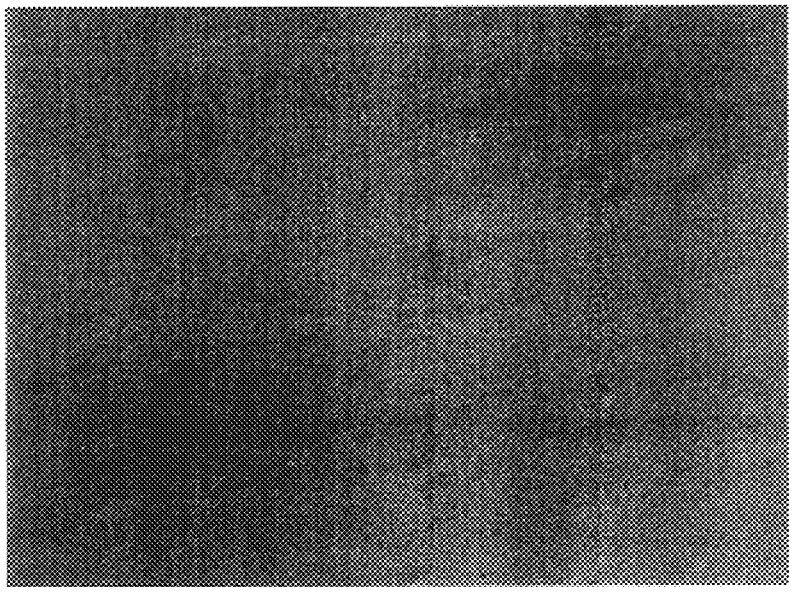

The present invention addresses and solves problems arising from the inability to achieve satisfactory layer deposition on substrates by means of electroless plating. More specifically, the inventive methodology avoids the problem of nodule formation during electroless deposition of amorphous NiP "seed" or plating layers on substrates utilized in the manufacture of high-density magnetic recording media.

According to the present invention, the above-described problem of nodule formation attendant upon the use of electroless deposition processing for the formation of amorphous NiP "seed" or plating layers on substrates utilized for the manufacture of magnetic recording media, such as hard disks, is substantially eliminated, or at least minimized, by utilizing an electroless apparatus, i.e., "line" wherein each of the various components or structures of the line is constituted of a material, e.g., a polymeric or polymer-based material, which is free of degradation upon contact with the elevated temperature electroless plating bath utilized for the deposition processing. More specifically, each of the polymers or polymeric-based materials utilized in the line is selected on the basis of its resistance to degradation by the electroless plating bath by a process wherein soluble, low molecular weight carbon (C)-containing species are released into the plating bath.

According to conventional methodology for electroless plating of e.g., amorphous NIP "seed" or plating layers utilized in the manufacture of magnetic recording media, materials of lesser chemical and thermal stability, such as hydrocarbon-based polymers, e.g., polypropylene, are widely utilized in the electroless plating industry in view of their low cost and wide availability. For example, a majority of the fixtures of a conventional electroless plating line, such as gears, main tank bodies, pipes, filters, etc., are typically formed of propylene.

However, it has been determined by the present inventors that unstable polymeric or polymer-based materials, including, for example, the commonly employed polypropylene, will undergo degradation upon contact with certain chemicals and/or when utilized in a high temperature environment (i.e., above about 140° C.), such as by contact with an electroless plating bath, to release soluble, low molecular weight, carbon-containing species into the bath, thereby causing contamination of the bath. While not desirous of being bound to any particular theory or mechanism for such degradation, it is believed that de-polymerization and/or other decomposition reactions occur as a result of contact with certain polymeric or polymer-based plating line materials under chemically aggressive conditions such as are encountered in electroless deposition processing, thereby leading to contamination of the plating bath.

It is further believed that the soluble, low molecular weight carbon-containing species released into the electroless plating bath as a result of the polymer degradation is (are) subject to co-deposition with the desired electroless coating material, e.g., amorphous NiP, which co-deposition can create active nucleation sites for accelerated, i.e., abnormal growth, leading to nodule formation during subsequent deposition necessary for achieving a desired deposit thickness. Such abnormal growth leading to nodule formation can result in creation of "bumps" which remain even after post-deposition polishing. While the problem of bump formation is alleviated somewhat when a two-step polishing process is employed which provides a high degree of material removal, the effect of abnormal nodule growth/bump formation is exacerbated when, e.g., a leveling agent is added to the NiP electroless plating bath and the post-deposition polishing involves only a small amount of material removal.

The present inventors therefore performed a series of experiments aimed at discovering: (1) the cause(s) and/or mechanism(s) of such abnormal nodule growth associated with electroless plating of amorphous NiP in electroless plating line apparatus comprising conventionally employed, less chemically stable polymeric and polymer-based materials such as polypropylene, which materials are subject to degradation by contact with chemically aggressive electroless plating baths at elevated temperatures; and (2) polymeric and polymeric-based materials free of deleterious degradation upon prolonged contact with electroless plating baths at high temperature, thereby resulting in nodule-free electroless deposition of, e.g., amorphous NiP "seed" or plating layers.

Figure 2A:
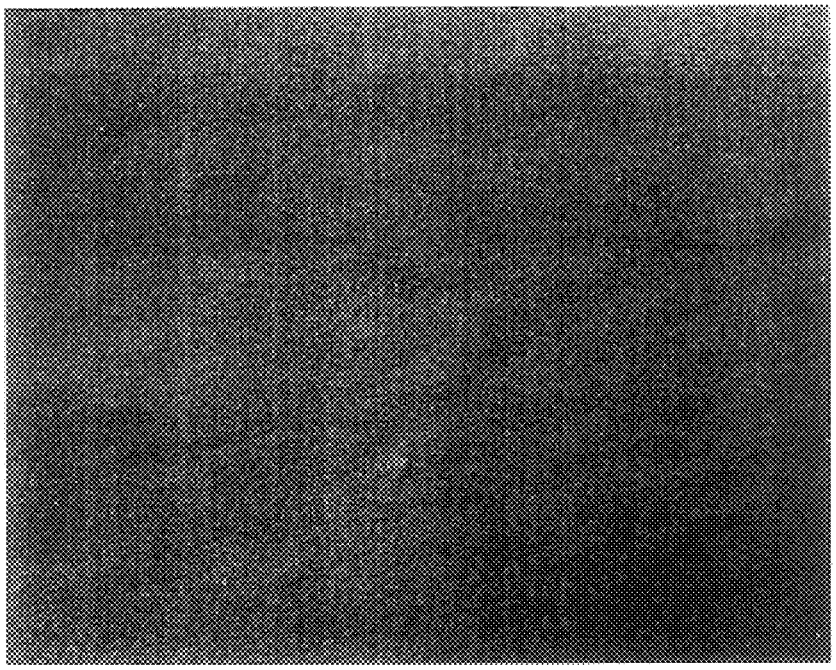
Figure 2B:
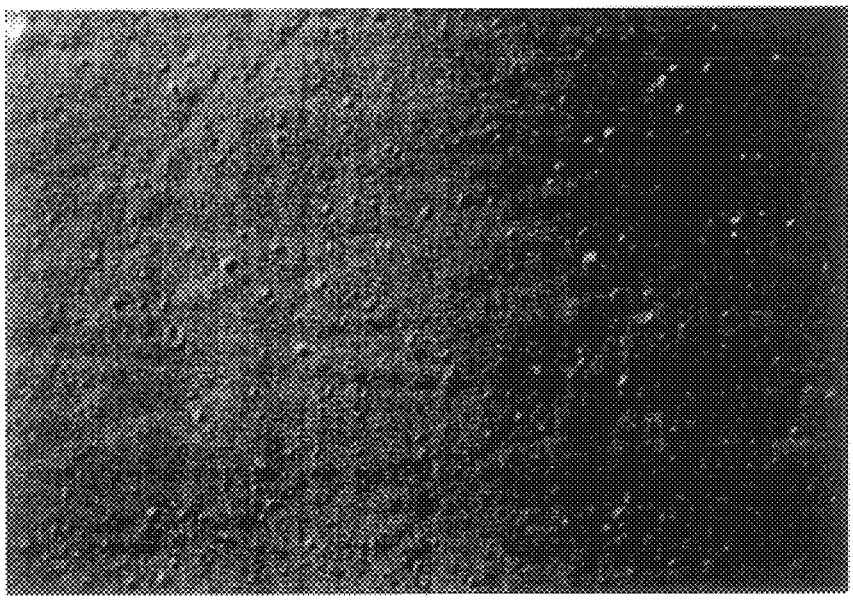
Figure 3:
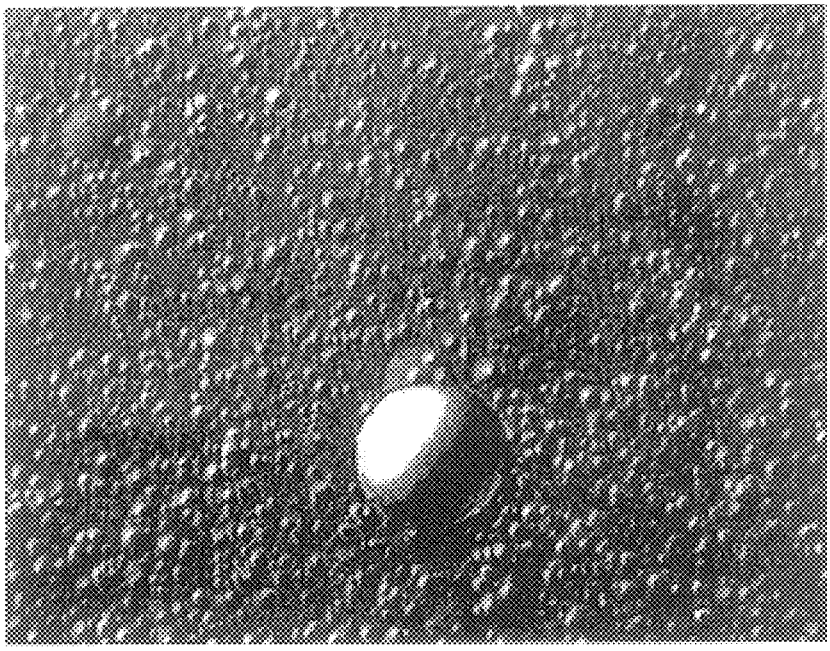

Experiment 1. Polypropylene strings and polyvinylidene difluoride (PVDF) bolts were placed in separate 3500 ml glass beakers filled with de-ionized ("DI") water and boiled, via a hot plate, until the water volume in each beaker was lower than about 100 ml. The beakers were again filled with DI water to about 3500 ml and boiled to a water volume of about 100 ml. The two beakers were then filled with identically constituted NiP electroless plating solutions. Two Al-based magnetic media substrates, simultaneously pre-plated with NiP in a standard production line, were placed in each of the beakers for electroless plating thereon of an amorphous NiP "seed" or plating layer, under standard plating conditions, and the surfaces thereof were examined microscopically and by SEM/EDX analysis. As is apparent from the photomicrograph of FIG. 2 showing the surface of the amorphous NiP "seed" or plating layer obtained by electroless plating utilizing the beaker containing the water boiled with the polypropylene strings, abnormal nodules are observed everywhere. By contrast, as is clear from the photomicrograph of FIG. 3 showing the surface of a similar NiP layer obtained by electroless plating under identical conditions but utilizing the beaker containing the water boiled with the PVDF bolts, no abnormal nodules are observed. SEM/EDX analysis indicated a high concentration of carbon (C) in the abnormal nodules illustrated in FIG. 2, therefore giving support to the hypothesis of de-polymerization of the hydrocarbon-based polymer (i.e., polypropylene) upon exposure to high temperature liquid for a sufficient time interval, resulting in formation of soluble, low molecular weight, carbon-containing species which, upon incorporation in the electroless plating deposit, can act as nucleation sites for abnormal nodule formation during further growth for achieving a desired layer thickness.

Experiment 2. An electroless plating apparatus or line employing relatively new polypropylene fixtures (i.e., less than about 6 mos. plating usage) was employed for electroless plating of smooth NiP coating layers on disk-shaped magnetic media substrates, utilizing a standard NiP electroless plating bath and conditions. As illustrated in the photomicrograph of FIG. 4 showing the surface of the thus-obtained NiP layer surface, small and fine nodules are observed. In order to confirm the bath contamination effect observed in Experiment 1, an electroless plating apparatus or line employing older polypropylene fixtures was utilized for performing a similar electroless NiP plating process on disk-shaped magnetic media substrates. As is apparent from the photomicrograph of FIG. 5 showing the surface of the thus-obtained NiP layer surface, a considerable amount of abnormal nodule growth is observed. In extreme cases, e.g., when the electroless plating line polypropylene-based fixtures are sufficiently old, such that release of low molecular weight carbon-containing species therefrom into the NiP electroless plating bath is substantial, extremely large abnormal nodules are formed, as illustrated in the photomicrograph of FIG. 6. In such instances, "bumps" remain on the NiP surface even after polishing, rendering the NiP-plated substrates unsuitable for further deposition thereon as required for the manufacture of magnetic recording media. In addition to the formation of very large abnormal nodules when a NIP electroless plating line utilizing very old polypropylene-based fixtures was employed, particles of white-colored polymeric material were observed floating on the surface of the NiP plating bath in the plating tank. Analysis of the floating particles indicated that they were composed of polypropylene, thereby providing evidence confirming the hypothesis of polymer degradation induced by contact with the electroless plating bath at elevated temperatures.

The chemical resistance (i.e., resistance to degradation) of a series of polymeric or polymer-based candidate materials for use as one or more fixtures (e.g., piping, tubing, seals, tank liners, racks, baking and washing caddies, etc.) forming part of a NiP electroless plating line comprising corrosion-resistant metallic materials (e.g., stainless steel) and degradation-susceptible polymeric or polymeric-based materials has been evaluated (Harrington Industrial Plastics, Inc., 48909 Milmont Drive, Fremont, Calif. 94538) by exposing samples of the candidate polymeric materials to a standard electroless NiP electroless plating bath at a temperature of at least 140° C. for at least about 24 hrs. and analyzing the resultant plating bath for carbon content. The results obtained are shown below in Table 1, wherein "good" chemical resistance indicates very low concentrations of soluble, low molecular weight carbon-containing compounds in the plating bath after exposure, i.e., less than about 10 ppm.

TABLE 1

| Polymer Material | Chem. Resistance | NiP Bath Temp., ° F. |
|---|---|---|
| polypropylene (PP) | poor | 140 |
| polyvinylidene difluoride (PVDF) | good | 250 |
| polyvinyl chloride (PVC) | poor | 140 |
| post-chlorinated PVC | poor | 140 |
| polytetrafluoroethylene/perfluoroalkoxy | good | 350 |
| polytetrafluoroethylene | good | 350 |
| polyvinylidenefluoride-hexafluoropropylene | good | 180 |

The following conclusions can be drawn from the results indicated in Table 1:

(1) hydrocarbon-based and/or chlorinated hydrocarbon-based polymeric materials, e.g., polypropylene, polyethylene, polyvinyl chloride, post-chlorinated polyvinyl chloride, etc. are subject to chemical attack (degradation) by the electroless plating bath, leading to contamination of the bath with about 10 ppm or more of soluble, low molecular weight, carbon-containing species released from the degraded polymeric or polymer-based material(s), which species can be incorporated into the electroless deposit., leading to formation of nucleation cites or centers for abnormal nodule formation during subsequent electroless deposition for achieving a desired, or target, layer thickness; and (2) the problem of electroless plating bath contamination by release of soluble, low molecular weight, carbon containing species from the polymeric or polymer-based material(s) can be substantially eliminated, or at least minimized, by utilizing for the electroless plating apparatus or line polymeric or polymer-based material (s) which is (are) substantially resistant to degradation upon extended contact with the elevated temperature electroless plating bath. Such degradation resistant polymeric materials include fluorine-containing polymers, more specifically, fluorine-containing hydrocarbon polymeric materials, such as polyvinylidene difluoride (PVDF) and poly(vinylidene fluoride)-hexafluoropropylene (Viton™), and fluorocarbon polymeric materials, such as polytetrafluoroethylene (Teflon™) and derivatives and composites thereof Accordingly, in view of the foregoing, the present invention provides a number of advantages over conventional processing for electroless deposition of smooth-surfaced, amorphous NiP "seed" or plating layers utilized as one of media manufacture. More specifically, the inventive methodology provides, inter alia, smoother-surfaced deposits requiring less post-deposition polishing, increases productivity by reducing the rejection rate of plated substrates, and reduces contamination of the electroless plating bath. Finally, the inventive methodology enjoys full compatibility with all other aspects of automated magnetic media manufacturing processing and the inventive concept is applicable to other electroless plating processes in addition to the specifically disclosed example pertaining to NiP electroless plating.

In the previous description, numerous specific details are set forth, such as specific materials, structures, reactants, processes, etc., in order to provide a better understanding of the present invention. However, the present invention can be practiced without resorting to the details specifically set forth. In other instances, well known processing materials and techniques have not been described in detail in order not to unnecessarily obscure the present invention.

Only the preferred embodiments of the present invention and but a few examples of its versatility are shown and described in the present invention. It is to be understood that the present invention is capable of use in various other embodiments and is susceptible of changes and/or modification within the scope of the inventive concept as expressed herein.

What is claimed is:

1. A method of depositing a nodule-free, amorphous nickel-phosphorus (NiP) coating layer on a substrate surface by means of an electroless plating process, wherein an electroless plating bath utilized for depositing said coating layer is contained at an elevated temperature within a plating apparatus including at least one polymeric material, comprising performing said electroless plating in a plating apparatus wherein the at least one polymeric material is substantially resistant to degradation by contact with the elevated temperature electroless plating bath.

2. The method according to claim 1, wherein the elevated temperature of the electroless plating bath is at least about 140° F. and the at least one polymeric material is substantially resistant to degradation which comprises release of soluble, low molecular weight, carbon-containing species into the electroless plating bath, which species promote nodule growth.

3. The method according to claim 1, wherein the at least one polymeric material comprises at least one fluorine-containing polymer.

4. The method according to claim 3, wherein the at least one fluorine-containing polymer comprises at least one fluorine-containing hydrocarbon polymer.

5. The method according to claim 4, wherein the at least one fluorine-containing hydrocarbon polymer is polyvinylidene difluoride (PVDF).

6. The method according to claim 4, wherein the at least one fluorine-containing hydrocarbon polymer is poly (vinylidene fluoride-hexafluoropropylene).

7. The method according to claim 3, wherein the at least one fluorine-containing polymer comprises at least one fluorocarbon polymer.

8. The method according to claim 7, wherein the at least one fluorocarbon polymer comprises polytetrafluoroethylene.

9. The method according to claim 3, wherein the at least one polymeric material comprises a derivative or composite of polytetrafluoroethylene.

10. The method according to claim 1, wherein the substrate is a disk-shaped substrate for use in fabricating a magnetic recording medium.

11. The method according to claim 10, wherein the substrate comprises a material selected from the group consisting of metals, metal alloys, polymers, glass, ceramics, metal-ceramic composite materials, and glass-ceramic composite materials.

12. The method according to claim 11, wherein the substrate comprises an aluminum-magnesium (Al—Mg) alloy.

13. A method of fabricating a magnetic recording medium, comprising the sequential steps of:

(a) providing a disk-shaped substrate having a surface for deposition thereon; and (b) electrolessly depositing, from an electroless plating bath maintained at an elevated temperature of at least about 140° F., a nodule-free, amorphous nickel-phosphorus (NiP) "seed" or plating layer on said substrate deposition surface, utilizing an electroless plating apparatus comprised of at least one polymeric material which does not release soluble, low molecular weight carbon-containing species into said elevated temperature electroless plating bath upon contact therewith.

14. The method according to claim 13, further comprising the sequential steps of:

(c) forming a polycrystalline underlayer over said NiP plating layer;

(d) forming a magnetic recording layer over said underlayer;

(e) forming a protective overcoat layer over said magnetic recording layer; and (f) forming a lubricant topcoat layer over said protective overcoat layer.

15. The method according to claim 13, wherein:

step (b) comprises utilizing an electroless plating apparatus comprising at least one fluorine-containing polymeric material.

16. The method according to claim 15, wherein said at least one fluorine-containing polymeric material is at least one fluorine-containing hydrocarbon polymer selected from polyvinylidene difluoride (PVDF) and poly(vinylidene-hexafluoropropylene).

17. The method according to claim 15, wherein said at least one fluorine-containing polymeric material comprises at least one fluorocarbon polymer selected from the group consisting of polytetrafluoroethylene, derivatives thereof, and composites thereof.

18. A method of electrolessly depositing a nodule-free layer of amorphous nickel-phosphorus (NiP) on a substrate surface, comprising:

providing a substrate having a surface; and utilizing a substantially degradation resistant means for nodule-free electroless plating of said layer of amorphous NiP on said substrate surface.

* * * * *